US007549538B2

(12) United States Patent
Naoe et al.

(10) Patent No.: US 7,549,538 B2
(45) Date of Patent: Jun. 23, 2009

(54) PACKAGING BAG FOR DIAPERS

(75) Inventors: Koichi Naoe, Tokyo (JP); Fumihiko Ukita, Tokyo (JP)

(73) Assignee: Uni-Charm Corporation, Ehime-ken (JP)

( * ) Notice: Subject to any disclaimer, the term of this patent is extended or adjusted under 35 U.S.C. 154(b) by 408 days.

(21) Appl. No.: 11/237,965

(22) Filed: Sep. 29, 2005

(65) Prior Publication Data

US 2006/0082133 A1 Apr. 20, 2006

(30) Foreign Application Priority Data

Oct. 1, 2004 (JP) ..... 2004-290539

(51) Int. Cl.
*B65D 73/00* (2006.01)

(52) U.S. Cl. ..... 206/494; 206/459.5

(58) Field of Classification Search ..... 206/494, 206/459.5, 457, 526, 499, 440; 40/312; 283/56, 283/70

See application file for complete search history.

(56) References Cited

U.S. PATENT DOCUMENTS 3,910,412 A * 10/1975 Vargo ..... 206/459.5
4,101,032 A * 7/1978 Obidniak ..... 206/457
4,440,298 A * 4/1984 Knight ..... 206/216
5,967,665 A * 10/1999 MacDonald et al. ..... 383/207
6,318,555 B1 11/2001 Kuske et al.
6,491,165 B2 * 12/2002 Kuske et al. ..... 206/494
6,763,944 B2 * 7/2004 Ronn et al. ..... 206/440
2002/0066688 A1 * 6/2002 Autterson ..... 206/459.5
2002/0072723 A1 6/2002 Ronn et al.
2002/0125171 A1 * 9/2002 Kuske et al. ..... 206/776
2003/0070955 A1 * 4/2003 Kuske et al. ..... 206/494
2003/0141214 A1 * 7/2003 Macguire ..... 206/459.5
2004/0211696 A1 * 10/2004 Underhill et al. ..... 206/494

FOREIGN PATENT DOCUMENTS

JP 5-65849 8/1993
JP 10-329903 12/1998
JP 2002-278455 9/2002
JP 2002-278491 9/2002
JP 2003-052502 2/2003
JP 2003-182747 7/2003

* cited by examiner

*Primary Examiner*—David T Fidei
(74) *Attorney, Agent, or Firm*—Lowe Hauptman Ham & Berner, LLP

(57) ABSTRACT

A packaging bag facilitates understanding that the contents are diapers for older children from the display on the packaging bag at low costs. The packaging bag contains disposable underpants-type diapers of which the intended wearers are children 10 months and older. The surface of the packaging bag includes an intended wearer illustration display part which mainly shows one or more illustrations of the intended wearer.

15 Claims, 8 Drawing Sheets

PACKAGING BAG FOR DIAPERS

CROSS-REFERENCE TO RELATED APPLICATIONS

This application is based upon and claims the benefit of priority from Japanese Patent application No. 2004-290539 filed on Oct. 1, 2004, the entire contents of which is incorporated herein by reference.

FIELD OF THE INVENTION

The present invention relates to a packaging bag for packaging disposable diapers and more particularly relates to a packaging bag for underpants-type diapers of which the target wearers are children of ages 10 months and over.

RELATED ART

In recent years, the quality of disposable diapers has improved significantly, and many infants and children wear disposable diapers. There are two types of disposable diapers, tape-type and underpants-type. Tape-type disposable diapers are held by affixing two locations around the waist with tapes and are for infants only a few months old. On the other hand, underpants-type disposable diapers are formed integrally as in underpants. The underpants-type disposable diapers can be put on while standing and are primarily for children 1 to 3 years old.

Generally, it is said use of diapers may be discontinued around two years of age, and it is preferable that toilet-training be started during this period. However, according to a recent study, although the average age of discontinuation of use of diapers during the daytime was 21.4 months in 1960, it was 30.5 months in 2000, and thus the age at which diaper use is discontinued has been delayed by about six months. In this way, the age of diaper discontinuation for infants and children in recent years is delayed, and consequently, older children than in the past require disposable diapers. Therefore, underpants-type disposable diapers of a large size (also referred to, hereinafter, as "large diapers"), usable by older children, who were conventionally not the target wearers of disposable diapers, are required.

Package for packaging conventional disposable diapers is shown in FIG. 8. FIG. 8 is a perspective view showing an example of a conventional diaper package. A package is known wherein a printed part 91 is provided on the surface of a package 90, and an illustration of a target wearer 92 (a newborn baby or an infant) in which a diaper 93 is worn and is visible is shown in the vicinity of the center of this printed part 91. Text information parts 94, 95, and 96, such as product name of a paper diaper, size of the diaper, and intended user are additionally provided in this printed part 91. By this package 90, it can be easily determined that the contents of the product are diapers by placing the illustration of the newborn baby or the infant wearing a diaper in a state wherein the diaper is worn and is visible.

In addition, Patent Reference 1, which will be described below, discloses a system enabling tiered guidance features as a selling display system for paper diapers which places a basic shelving having shelves to align and store paper diapers on the floor, and as well as places promotional sheets corresponding to the rows of stored paper diapers on the floor, and places promotional goods corresponding to the paper diapers on the shelf.

Patent Reference 1: Japanese Patent Application Laid-Open Publication No. 2003-52502.

As stated above, conventionally, appropriate paper diapers for newborn babies and infants are chosen from among products and are used depending on the age in months. Generally, use of underpants-type disposable diapers for children ages 1 to 3 follows that of tape-type disposable diapers targeting relatively young infants. Therefore, a display which can clearly differentiate these product groups is required on packaging bags.

In this respect, conventionally, differentiation among these product groups was made by methods such as printing specific numeric values and words, such as "size larger than . . . ", "for weights . . . kg to . . . kg", and "for heights . . . cm to . . . cm", onto the packaging bag as text information or by changing the base color according to the product group. However, as the differentiation among product groups is still insufficient, there are problems in that erroneous purchase occurs due to mistaken identification.

Because these large diapers are a product group which did not exist, it is required that the purchaser be able to clearly differentiate large diapers which target older children from conventional diapers for very young infants by the packaging bags. However packaging bags having a display part appropriate for such large diapers has not been examined.

In addition, the system in Patent Reference 1 relates to a guidance method for efficiently selling paper diapers for nursing-care, which is used by the purchaser, particularly the elderly. Methods for differentiating product groups from similar paper diapers are not examined.

SUMMARY OF THE INVENTION

The present invention has been made in view of the problems above. An object of the invention is to provide a packaging bag which enables easy identification of the contents as diapers targeting older infants from the display on the packaging bag. Furthermore, an object of the invention is to provide a packaging bag which can be manufactured easily at a low cost, a diaper package therewith thereof, and a diaper package display.

In order to achieve the above objects, the present invention specifically provides the following:

(1) A packaging bag for diapers for packaging disposable underpants-type diapers of which an intended wearer is a child 10 months old or older, in which an intended wearer illustration display part mainly showing one or more illustrations of the intended wearer on a surface of the packaging bag, the intended wearer illustration display part including a character part showing the intended wearer wearing clothes in a state in which a diaper is worn so as not to be exposed to outside the clothes, the intended wearer illustration display part is disposed on a roughly rectangular area which is 60% to 90% of an upper part in a vertical direction of the overall packaging bag when the packaging bag is empty, and the character part is disposed near a center line along a direction which is the vertical direction of the packaging bag.

According to the packaging bag for diapers described in (1) from a glance at the "character part", it is clear that the target wearers are older infants, because the "character part" on the front surface of the packaging bag shows the intended wearer wearing a diaper so that it is not exposed outside the outer clothes. Therefore, this can effectively prevent purchasers from misidentifying and purchasing diapers of a wrong size at a store because purchasers can clearly differentiate large diaper package from other diaper package for very young infants. "An upper part in a vertical direction of an entirety of the packaging bag" means the upper part of an unused empty packaging bag in its normal flattened state, and here, "upper part" refers to the head direction of the target wearer shown in the character part.

In addition, by allocating the character part in the vicinity of a center line along the vertical direction of the packaging bag, the character part is well-balanced even when the packaging bag is filled with diapers, and a packaging bag with an overall pleasing appearance can be provided.

Furthermore, including the character part showing the intended wearer wearing clothes, a pattern of the clothing part can be easily changed, for example, according to the seasons. Therefore, a product which changes seasonally can be provided merely by changing a design of the clothing part, and the design can be changed at low cost. Although the design of the clothing part is changed, the intended wearer illustration display part remains the same including the character part which shows the intended wearer wearing clothes. The differentiation of the diaper product group for diapers of which the target wearers are children of ages 10 months and older from other diaper product groups can be sufficiently made.

In addition, by assigning the intended wearer illustration display part to a roughly rectangular area which is 60% to 90% of the upper part of the packaging bag when the packaging bag is empty, mainly the intended wearer illustration display part covers a face of the diaper package excluding a bottom surface part, when the diaper package contains the diapers is displayed. No printed illustration is required in a part which is folded into a lower-portion when the packaging bag is filled with the diaper package. Therefore, the intended wearer illustration display part can be allocated to only a required area appealing to the eye of the purchaser, and at the same time, a low-cost packaging bag can be provided by eliminating printed display areas.

Furthermore, it is known that children of ages 10 months and older can differentiate picture elements and four colors, although they cannot understand meanings of text information. Therefore, according to the packaging bag of the present invention, the child, who is the wearer, can differentiate the underpants-type diapers of which the intended wearers are children of ages 10 months and older from other paper diaper product groups. Thus, the children also can express their desires when purchasing.

(2) In the packaging bag for diapers according to (1), wherein the intended wearer illustration display part shows a child who is three to six years old.

According to this embodiment, if the intended wearer is three to six years old, it is thought that he prefers selecting product groups which shows intended wearers wearing clothes, because the intended wearer's emotions such as shyness may have developed, in addition to the above acknowledgement of picture elements and differentiation of four colors. Therefore, an intended wearer will exhibit much interest in the packaging bag of the present invention, and he can express his desires more strongly when purchasing.

(3) In the diaper package formed by packaging the diapers in the packaging bag for diapers according to (1) or (2), wherein the character part is placed in a position which is to be a front face of the diaper package when the diaper package is in a displayed state.

According to the diaper package described in (3), positioning the character part to a center part of the front face of the diaper package when the diaper package is displayed makes it possible to appeal strongly to the eye of the purchaser, and it also makes it possible to know at a glance that the contents of the diaper package are diapers of which the intended wearers are children ages 10 months and older. In addition, the diaper package which is well-balanced and with pleasant appearance when displayed can be provided. The "front face of the diaper package," refers to the face by which the purchaser can recognize the product best in a normal display state in which a number of packaging bodies are piled and arranged. The front face is normally the face with a largest dimension on the packaging body in which the product name and the character part is displayed at its largest.

(4) A diaper package display includes:

a first package group formed by arranging plural the diaper packages according to (3) and displaying; and a second package group formed by arranging plural the second packages containing disposable diapers smaller than diapers including the first package group, one of the second package including a second intended wearer illustration display part mainly showing one or more illustrations of a newborn or an infant on a surface thereof, the second intended wearer illustration display part including a second character part showing the newborn or the infant wearing the small diaper in an exposed state in which the first package group and the second package group are displayed so as to be horizontally or vertically adjacent.

The diaper packaging display according to (4) is one in which the first package group, which are displays of the diaper packages for underpants-type diapers of which the intended wearers are children ages 10 months and older, and the second package group, which are displays of the diaper packages of disposable diapers of sizes smaller than the diapers including the first package group (also referred to, hereinafter, as "small diapers"), are displayed so as to be vertically or horizontally adjacent. Because the character part on each surface of diaper packages of the first package group shows the intended wearer wearing clothes in a state in which the diaper is worn so as not to be exposed outside the clothes as described above, when only seeing the character part of an individual diaper packaging body will make it possible that will increase the likelihood that it is unclear for purchasers whether the diaper package is filled with diapers. However, in the diaper packaging display of the present invention, the second packaging group which includes the second character part showing the newborn baby or the infant wearing the conventional small-sized diaper in the exposed state is positioned such as to be adjacent to the first packaging group. Therefore, it can be understood that the diaper packages including the first packaging group are the diaper packages for diapers in the store, and therefore, mistaken identification by the purchaser of the diapers as other products can be avoided.

(5) In the diaper package display according to (4) in which the first and second diaper package groups are displayed on shelves formed vertically and placed according to age of intended wearer.

According to this embodiment, because respective diaper packages are allocated to and placed on shelves which are formed vertically in plural levels, a usual location of respective diaper package groups can be predetermined, and therefore, a target product can be easily found when the purchaser purchases the product again. In this case, the first package group is preferably placed in a location close to a purchaser's eye level, which is the upper part of the shelf. This makes it possible to easily differentiate the product groups because it is much visually appealing.

Definition of Terms

In the present specification, "children" refers to ages 10 months to six years. In addition, "disposable" refers to those manufactured and sold as "disposable products" such as so-called paper diapers, regardless of a length of the time of use and duration of use. Furthermore, "underpants-type" refers to those which are formed integrally like underpants and can be fitted while standing, in general.

"Display" refers to placing and aligning products to be sold such that they can be viewed by general consumers and purchasers. Therefore, when stating "display on shelves in distribution outlets", for example, if the products are placed on shelves which are placed in locations that cannot be viewed by general consumers, this does not fall under the "display" stated in the present specification. However, in the case in which the products are placed on shelves which are placed in locations that can be viewed by general consumers, it is included in the concept of "display" stated in the present specification, regardless of an order and a configuration of the placement/alignment, as long as the products are placed/aligned so as to catch the eyes of general consumers in one way or another. In addition, "display" includes a state in which products are simply stacked or aligned and, for example, also includes a state in which the products are lined up in store fronts while packed within cardboard boxes for distribution of which at least one side has been opened.

Furthermore, "purchasers" in the present specification includes, not only persons who actually consume the product and persons who actually purchase the product, but also persons who has not actually consumed or purchased and only have a desire to consume or purchase.

According to the packaging bag for diapers of the present invention, it can be acknowledged easily from the intended wearer illustration display part that the contents of the packaging bag are disposable underpants-type diapers of which the intended wearers are infants in their later months of infancy. Furthermore, the packaging bags can be manufactured easily at low costs.

DESCRIPTION OF THE PREFERRED EMBODIMENTS

With reference to drawings, each embodiment of the present invention will be described hereinafter in detail. In the description of the embodiments below, identical components are given identical numerals and explanation is omitted or simplified for the sake of brevity.

Packaging Bag for Diapers

Figure 1:
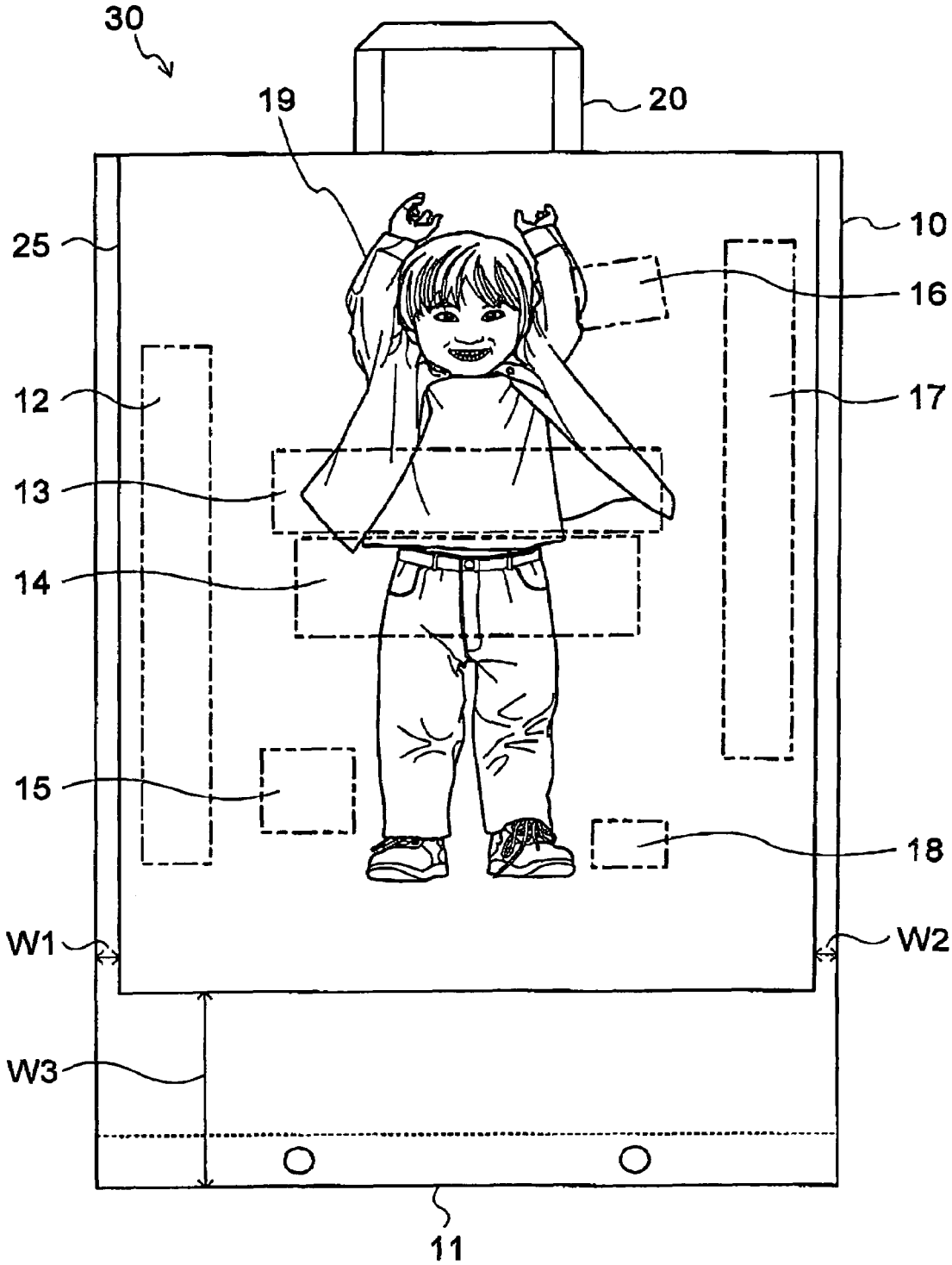
FIG. 1 is a diagram of an example of a packaging bag for diapers of the present invention viewed from the front of the packaging bag for diapers.
Figure 2:
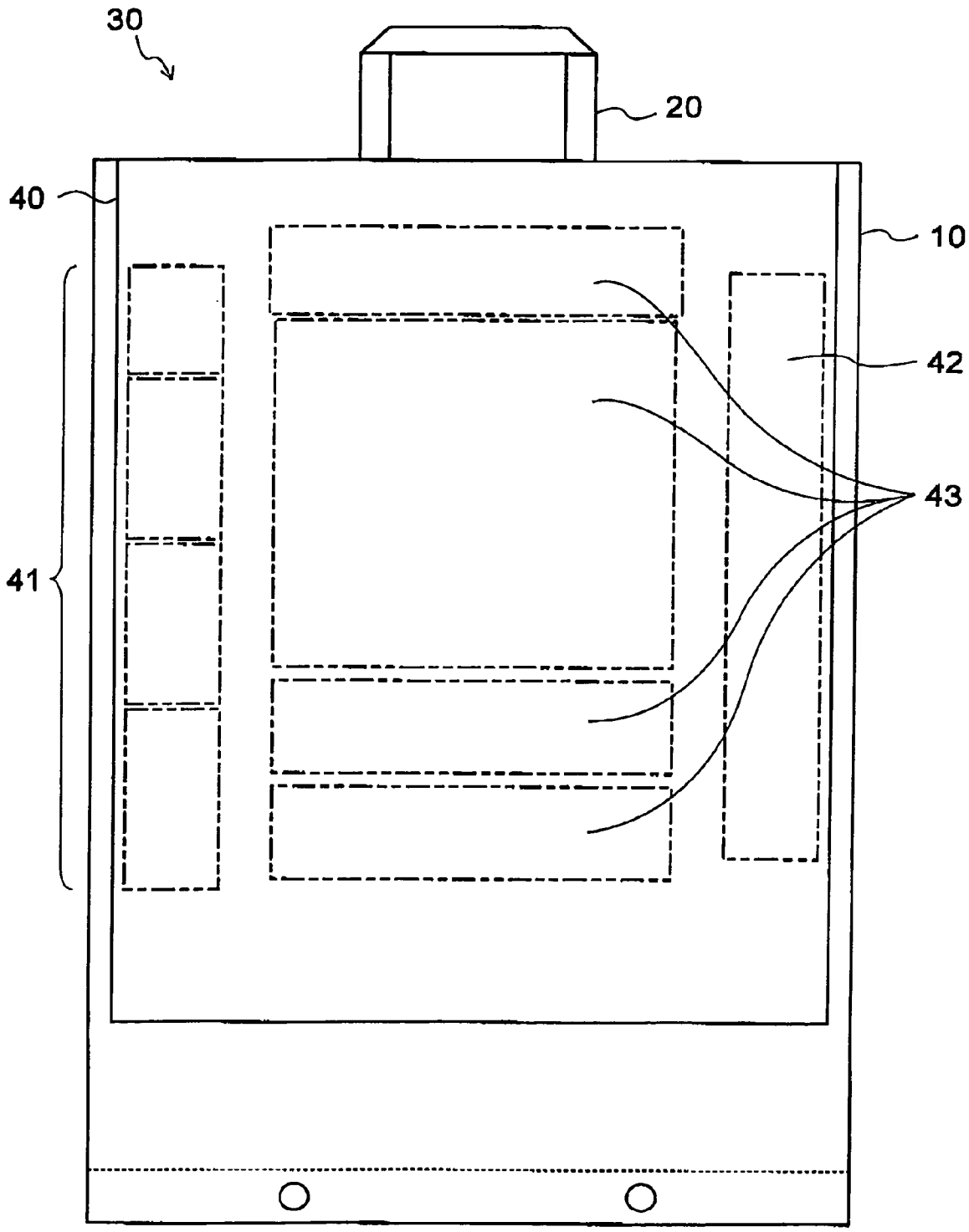
FIG. 2 is a diagram of an example of a packaging bag for diapers of the present invention which is viewed from the rear of the packaging bag for diapers.

FIG. 1 is an example of a packaging bag for diapers of the present invention and is a diagram seen from the front of the packaging bag for diapers. FIG. 2 is a diagram seen from the back. The packaging bag for diapers 30 according to this embodiment includes a main body 10 which has a roughly rectangular shape as a whole and pair of ribbon like handle parts 20 which are attached in an inverted U-shape on an upper part thereof, as seen in FIG. 1.

The main body 10 is placed such that two sheets of roughly rectangular film, forming the front and the back, are layered. On the upper side, a separate film which is not shown is sandwiched between the sheets so as to form a gusset folding part, and in this state, both sides of the two sheets of film, forming the front and the back, and the upper side are heat-sealed, and thus the main body 10 is formed. The bottom side of the packaging bag 30 is not heat sealed and has an opening part 11 for inserting in the diapers which are the contents. The main body 10 and the handle part 20 are formed from known film-type components such as polyethylene and polypropylene, respectively, and both are joined by heat-sealing. A size of the main body 10 is set accordingly based on the size of the diapers and the number of diapers packaged. It is preferably 300 mm to 500 mm in width and 200 mm to 800 mm in height in the state in FIG. 1, and the gusset part 51 of the upper part (refer to FIG. 5) preferably has a width of 200 mm to 400 mm when opened as in FIG. 5.

The intended wearer illustration display part 25 showing mainly one or more illustrations of the intended wearer is printed on the front face of the main body part 10 in FIG. 1. This intended wearer illustration display part 25 is disposed to the roughly rectangular area of the upper part of the packaging bag 30 for diapers when the packaging bag 30 is empty. The intended wearer illustration display part 25 is disposed to the roughly rectangular area which is 60% to 90% of the upper part in the vertical direction of the overall of the packaging bag when the packaging bag is empty. In this embodiment, the intended wearer illustration display part 25 is printed such as to cover the upper side of the main body 10, but it may also be placed such as not to cover the upper side by providing 30 mm to 150 mm of non-printed area. In addition, the left and right non-printed areas W1 and W2 in FIG. 1 are preferably 5 mm to 30 mm, and a bottom non-printed area W3 is preferably 30 mm to 150 mm.

Figure 3:
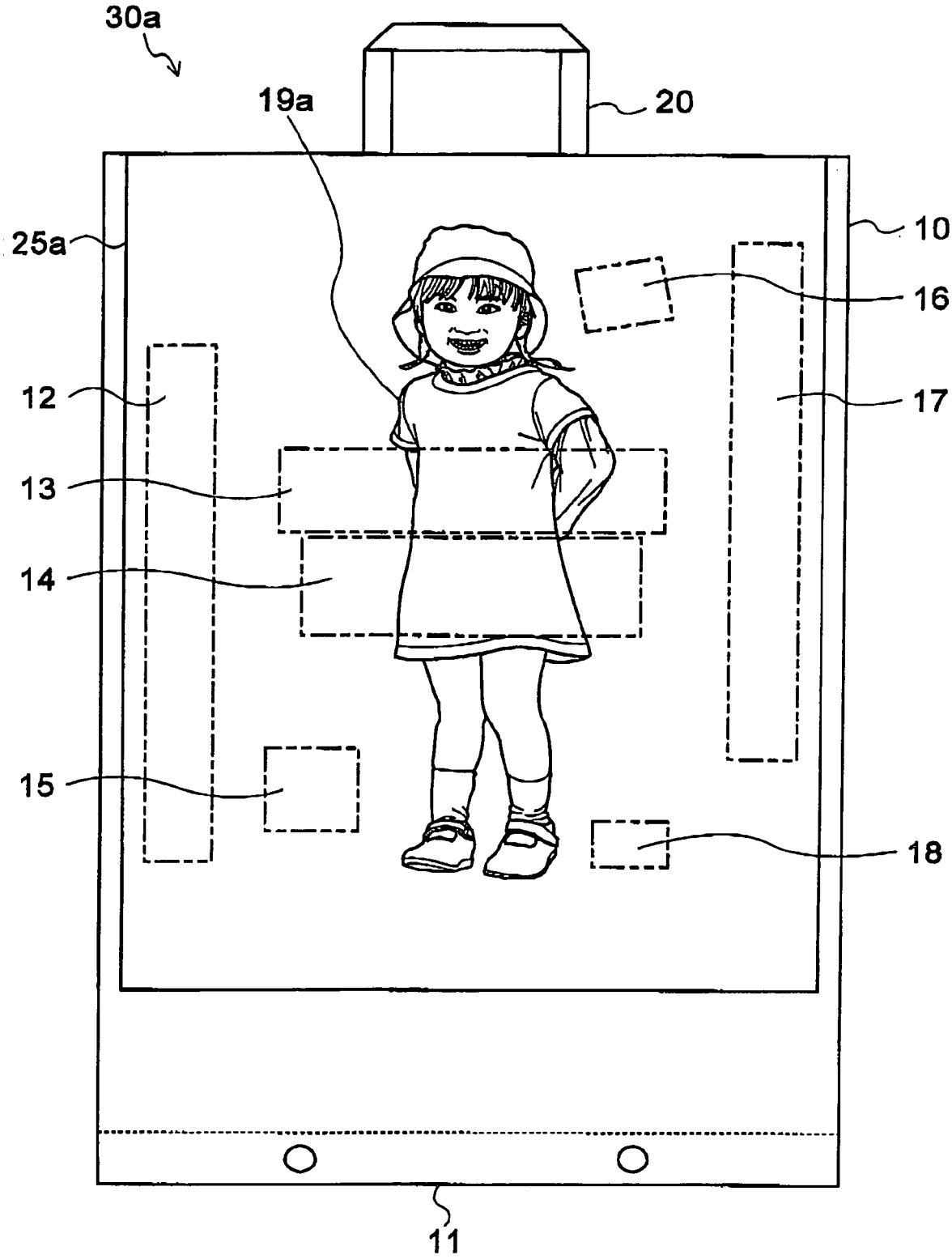
FIG. 3 is a diagram of another example of a packaging bag for diapers of the present invention viewed from the front of the packaging bag for diapers.
Figure 4:
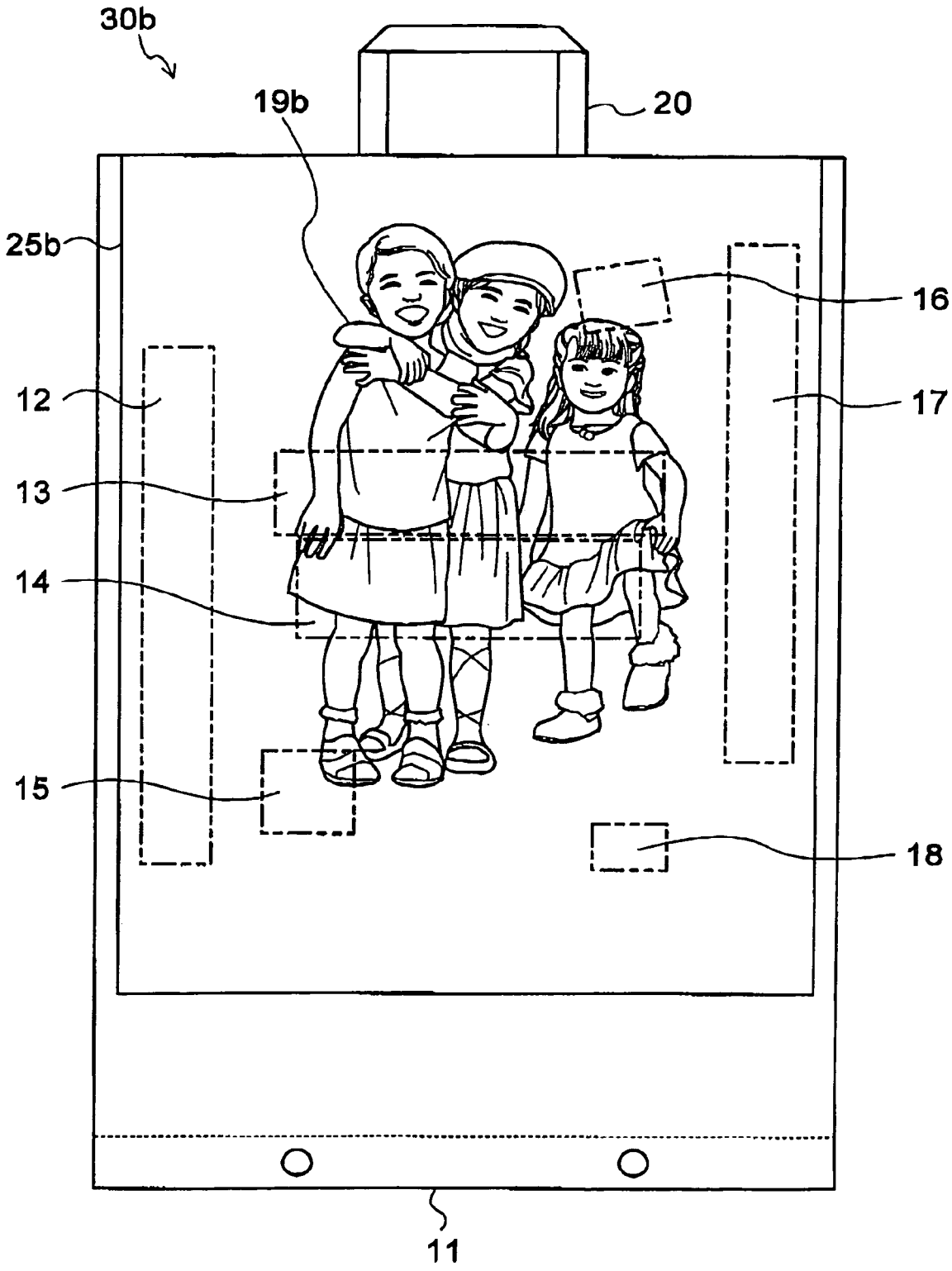
FIG. 4 is a diagram of another example of a diaper packaging bag of the present invention viewed from the front of the packaging bag for diapers.

The intended wearer illustration display part 25 has a character part 19 showing the intended wearer wearing clothes in a state wherein the diaper is worn so as not to be exposed to outside the clothes. This character part 19 is placed in the vicinity of a center line along the vertical direction of the packaging bag for diapers 30. The intended wearer in the character part 19 is a child of age 10 months and older and is preferably three to six years old. The intended wearer in the character part 19 shown in FIG. 1 is a boy, but it may also be a girl as shown in the character part 19*a* in the intended wearer illustration display part 25*a* in FIG. 3. Furthermore, the intended wearer is not necessarily one person, and may also include a plurality of intended wearers as shown in the character part 19*b* in the intended wearer illustration display part 25*b* in FIG. 4.

In this way, in the present invention, the target of the product is able to be recognized at a glance, by placing the character part 19 in a state wherein a child of age 10 months or older who is the intended wearer of the diaper is wearing clothes, and by showing this character part 19 overtaking other descriptions in a location at which it is easy to catch the eye along the center line in the vertical direction of the packaging bag for diapers 30.

In the present invention, the character part can be placed in other locations, for example, a side of the diaper package. That makes it possible to recognize the intended wearer according to the target of the packaged paper diapers from as many angles as possible. Furthermore, an erroneous purchasing due to a mistaken identification of contents can be reduced even when a large number of products are stacked and displayed, such as display in a tiered state.

Tex information parts 12 to 18 for mainly indicating text information which are product name of the paper diapers, size of the diapers, and intended user are provided together with the character part in the intended wearer illustration display part 25. These text information parts are to display in a printing the product name, the intend user and the like in order to clarify the differentiation of each sort of diapers because basically an entire construction of the diapers packaged in the packaging bag for diapers 30 are mostly the same, although an amount of absorbent body, a construction of the product, a thickness of the product and the like of paper diapers differ depending on a growth. In particular, text information may be "size larger than . . . ", "for weights . . . kg to . . . k", "for heights . . . cm to . . . c", "contains . . . diapers" and the like, other than the product names or company names, but are not necessarily limited to letters. Moreover, images such as characters other than the character part 19 may be employed. Text information part 12 and 17 are sections which will be shown on the side face of the packaging body depending on the width of the above described gusset part when the contents are filled as will hereinafter be described with FIG. 5.

A printed part 40 is formed on the back face side of the packaging bag for the diapers 30 as shown in FIG. 2, in a location which is almost corresponding to the intended wearer illustration display part 25 in FIG. 1. The text information mainly indicates the product name of the paper diapers, the size of the diapers, and the intended user as stated above, letters and images showing more specific directions of use are printed as information parts 41 to 43. Information parts 41 and 42 are displayed on a side face of the diaper package depending on the width of the gusset part when the contents are filled.

Diaper Package

Figure 5:
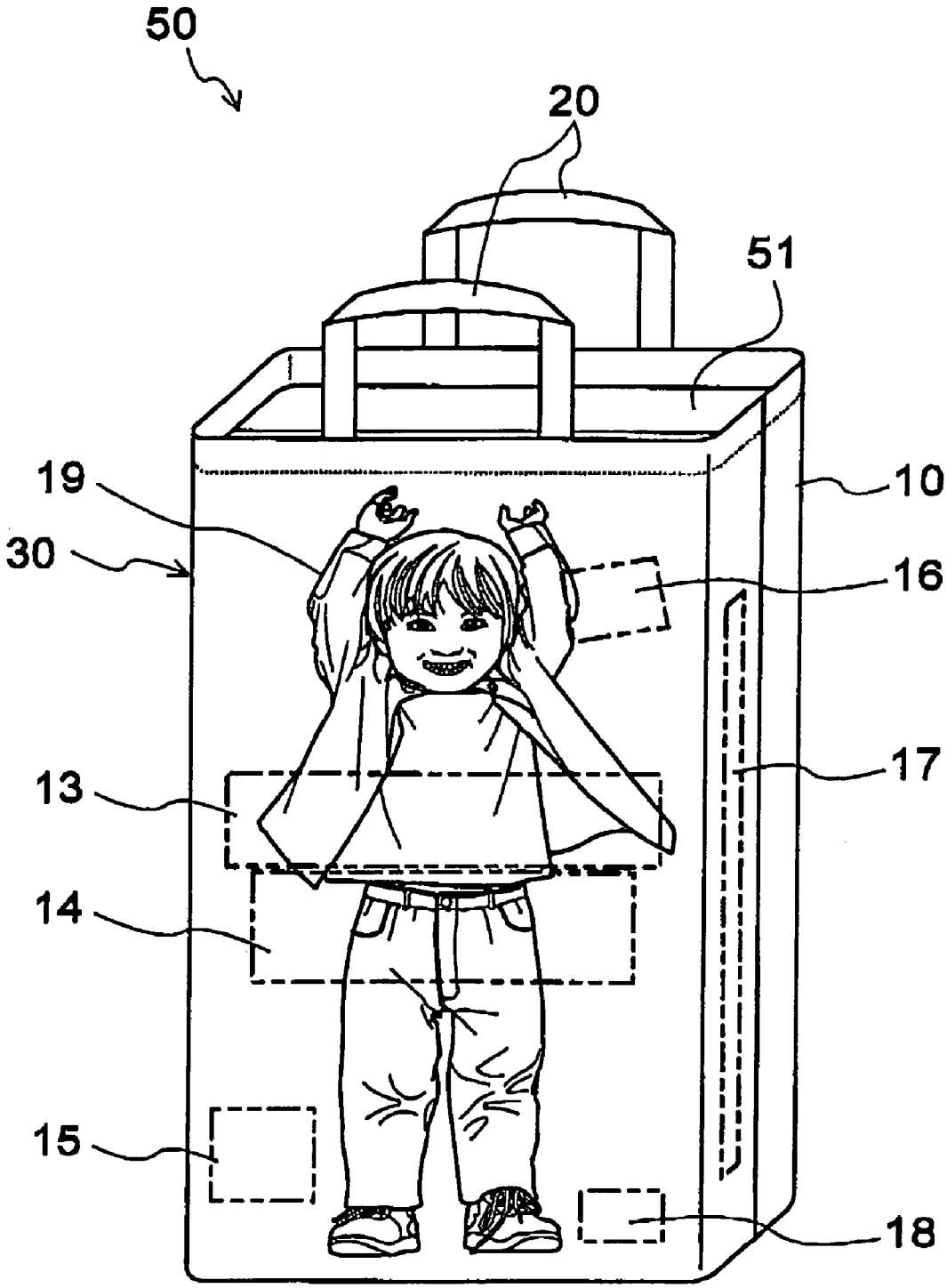
FIG. 5 is a perspective view showing a diaper package of the present invention, wherein the packaging bag for diapers in FIG. 1 is filled with large diapers.

After filling the inside of the packaging bag for diapers 30 with the above-described large diapers, preferably 10 to 70 thereof, the opening part in a lower-portion of the packaging bag for diapers 30 is folded and hermetically sealed, and a roughly rectangular parallelepiped diaper package 50, as shown in FIG. 5, is obtained.

As shown in FIG. 5, the character part 19 of the packaging bag for diapers 30 is placed in a location which is to be the front face of the diaper package when the diaper package 50 is displayed. The character part placed in the center part of the front face of the diaper package makes it possible to strongly catch the eye of purchasers, and to make known at a glance that these are diapers of which the intended wearers are children of ages 10 months and older when the packaging body is displayed. It also makes it possible to provide a diaper package which is well-balanced and of pleasing appearance when displayed.

As the diapers to be filled with the packaging bag for diapers 30, they are not particularly limited as long as they are disposable underpants-type diapers of which the intended wearers are children of ages 10 months and older, and those which are conventionally known are used. As such diapers, for example, underpants-type disposable diapers provided with an underpants-shaped diaper main body and an absorbent body for absorbing the bodily fluids of a wearer provided in the diaper main body can be exemplified. Out of these, preferably the above large diapers of which the target wearers are ages three to six years old are employed. In this case, for the size of the large diapers, the measurement in the waistband direction before wearing is preferably 130 mm to 200 mm, and the measurement in the direction perpendicular to the waistband direction is preferably 180 mm to 250 mm.

The amount of water absorption of the absorbent body of the above large diaper is preferably larger than that of conventional diapers, 850 g to 1050 g or less. The "amount of water absorption" refers to the largest amount of water the absorbent body can absorb, in particular, is the amount of water which can be retained even when a weight of 10 kg is applied. The "amount of water retained" refers to the largest amount of water which can be retained of a moisture absorbed by the absorbent body, and in particular, is the amount of water retained when dewatered at 75 G.

Diaper Package Display

Figure 6:
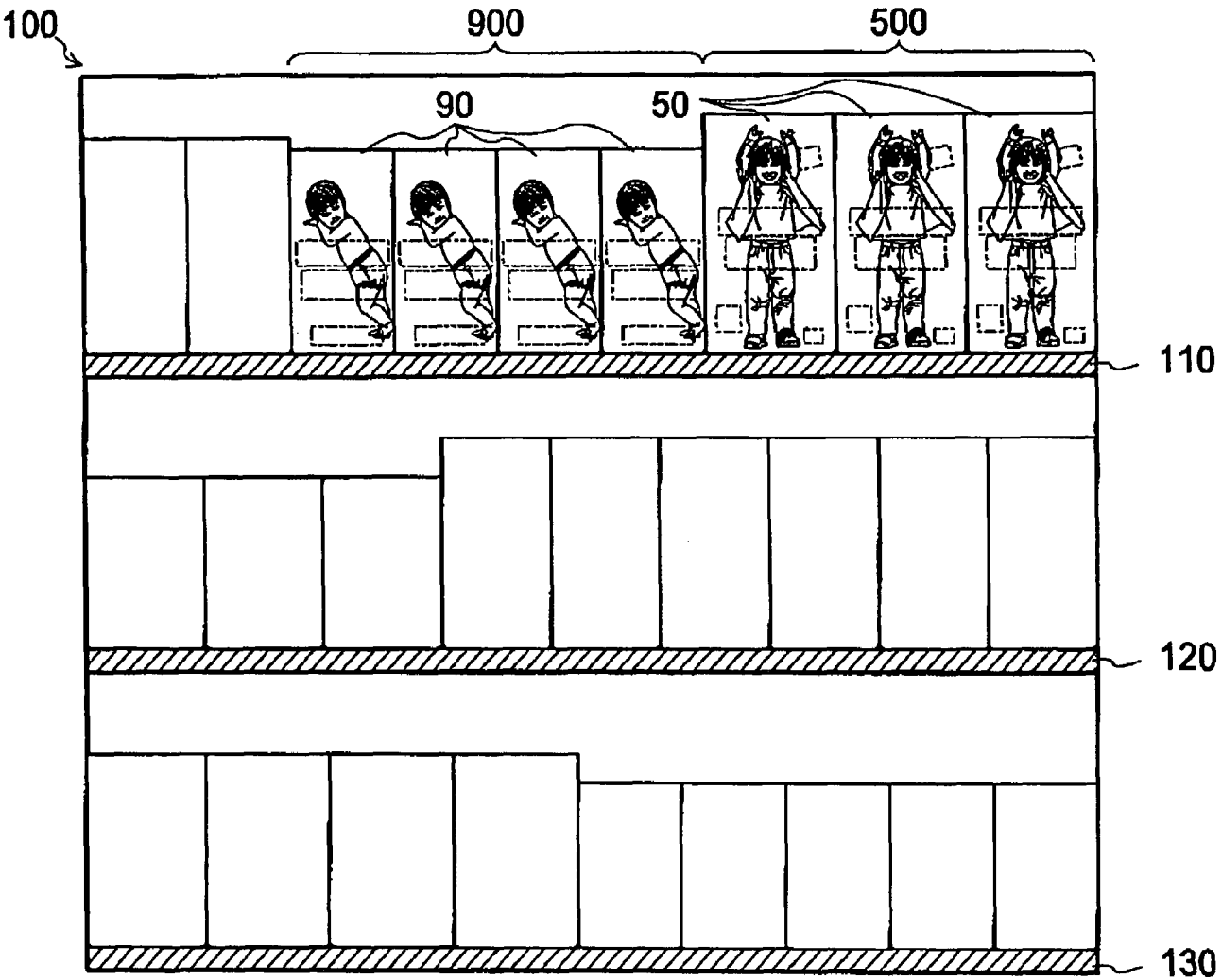
FIG. 6 is a front view showing an example of a diaper package display for diaper package of the present invention, wherein the diaper package in FIG. 5 is displayed.

FIG. 6 is a diagram showing an example of the display diaper package of the present invention. The above-described diaper package 50 is shown in a state in which it is displayed on shelf 100. In FIG. 6, shelving 100 is divided into plural layers by shelf boards 110, 120, and 130 (three layers in the present invention). The paper diapers for articles are sorted out and stored being classified depending on type, shape, night-day, intended wearer, materials and the like in row (horizontal) and column (vertical) form on the respective shelves.

In shelving 100, other than the above, promotional sheets may be placed displaying the type, characteristics and the intended wearer of the paper diapers and the like on the floor surface corresponding to the columns of stored paper diapers. Long rail promotional goods displayed on a front surface of each layer on the shelf may be provided, and partitions may be set on a boundary location or an end portion of different types and intended wearers of the paper diapers in each row.

In FIG. 6, the first package group 500 is shown in which diaper packages 50 are aligned and displayed. Although three diaper packages 50 are displayed in FIG. 6, the same diaper packages 50 are displayed in the depth direction(not shown), as well. Therefore, the first package group 500 may be one when seen from the front side and displayed only in the depth direction.

Figure 8:
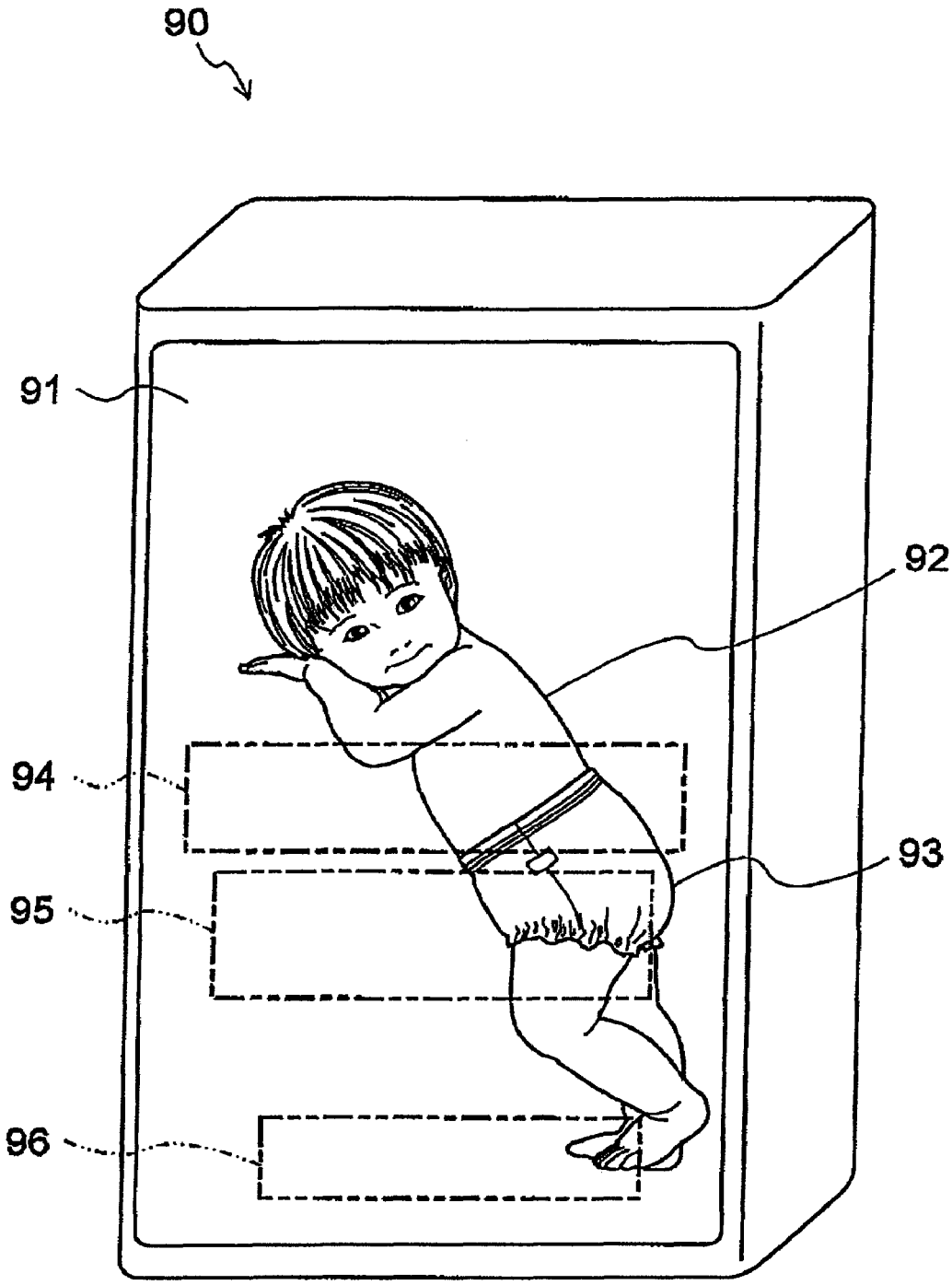
Fig. 8 (PRIOR ART)
FIG. 8 is a perspective view showing an example of a conventional diaper package.

On the left side of the first package group 500, the second packaging body group 900 is displayed, displaying plural second diaper packages which package disposable diapers of a size smaller than the diapers including the first packaging body group (small diapers). The second diaper package 90 is the same as the diaper package 90 in FIG. 8 shown in the prior art. A printed part 91 is provided on the surface of the diaper package 90. In the vicinity of the center of the printed part, illustrations are shown of which the target wearer 92 is a newborn baby or infant wearing diaper 93 in an exposed state.

In this way, displaying the first packaging body 500 and the second diaper package horizontally adjacent makes it possible for persons purchasing the products to understand how the products are differentiated and sold, and also makes it possible for such consumers to understand at a glance that the intended wearer of the packaged paper diapers are "children of ages 10 months and older". In addition, because the diaper packages 50 of the first package group 500 are large diapers, the outer size is slightly larger than the diaper package 90. An impression given at the difference in size makes it more easy to recognize the first package group 500.

In other words, because the character part on each surface of diaper packages of the first package group 500 shows the intended wearer wearing clothes in a state in which the diaper is worn not being exposed outside the clothes as described above, when only seeing the character part of the individual packaging body 50 will increase the likelihood that it is unclear for purchasers whether the diaper package is filled with diapers. However, in the diaper package display of the present invention, the second diaper package group 900, which includes the second character part showing the newborn baby or infant wearing the conventional small-sized diaper in an exposed state, is positioned such as to be adjacent to the first package group. Therefore, purchasers definitely understand that the diaper package including the first package group 500 are diaper packages because the second package group 900 showing the new born baby or infant wearing a diaper is displayed next to the first package group 500 in the store. It also prevents purchasers from misidentifying the diapers as other products. At the same time, comparing with the display of the second package group 900 makes it clear at a glance that the intended wearers of the first diaper package 500 are older by months. Thus the intended wearers are understood clearly, and the target product can be found immediately out of the displayed product groups.

Figure 7:
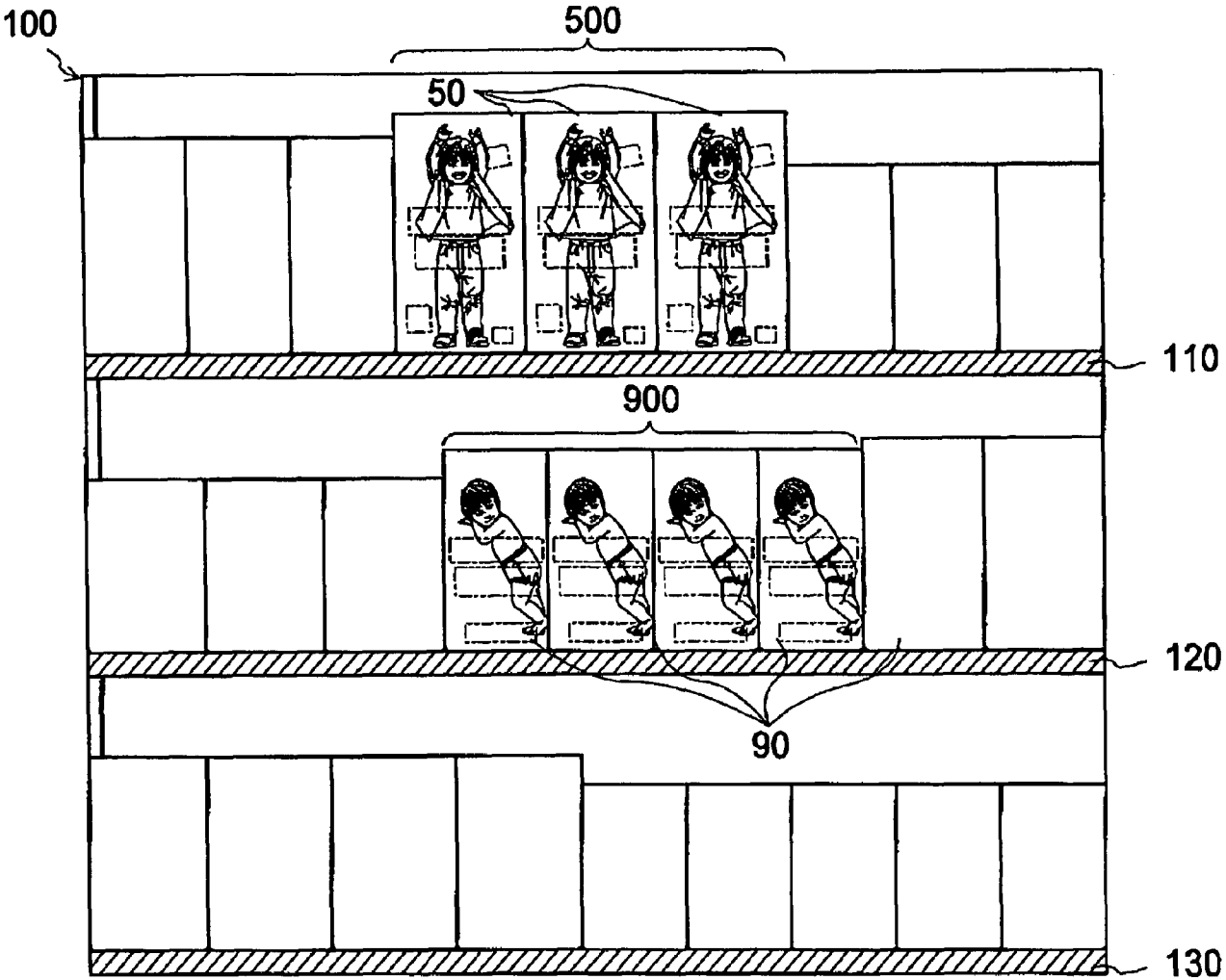
FIG. 7 is a front view showing another example of a diaper package display for diaper package of the present invention, wherein the diaper package in FIG. 5 is displayed.

The first package group 500 and the second package group 900 may be displayed not only horizontally adjacent as shown in FIG. 6, but also adjacent vertically on shelf boards 110 and 120, as shown in FIG. 7.

As far as the first package group 500 and the second package group 900 are displayed to be adjacent, other display sequences may also be set together and, for example, they can be aligned in order depending on growth stage, aligned seasonally such as spring/summer and autumn/winter, or aligned depending on popularity.

What is claimed is:

1. A packaging bag for diapers of which an intended wearer is a child 10 months old or older, said packaging bag comprising:

opposite front and rear faces, and opposite side faces connecting the front and rear faces, respectively;

a pair of handles each being attached in an inverted U-shape to an upper portion of said packaging bag and across a vertical center line of the front face of said packaging bag;

an opening part in a lower portion of said packaging bag for insertion of the diapers into the packaging bag;

an intended wearer illustration display part mainly showing one or more illustrations of said intended wearer on the front face of said packaging bag, said intended wearer illustration display part comprising a character part showing said intended wearer wearing clothes in a state wherein a diaper is worn so as not to be exposed outside said clothes;

a plurality of text information parts that include product information about the diapers contained in the packaging bag, said text information parts comprising first text information parts on at least one of the side faces of the packaging body;

second text information parts positioned between said intended wearer illustration display part and said first text information parts; and third text information parts positioned horizontally in a width direction of said packaging bag and across said intended wearer illustration display part;

wherein said intended wearer illustration display part and said first through third text information parts are all disposed on a roughly rectangular area which is 60% to 90% of an upper part in a vertical direction of the overall packaging bag when said packaging bag is empty, whereas a lower part of the empty packaging bag defines the opening part, said rectangular area defines at least the front face as well as parts of the side faces where the first text information parts are positioned;

said character part is disposed near the center line along the vertical direction of said packaging bag;

when said packaging bag is filled with the diapers, said diapers are not visible through the front face on which the intended wearer illustration display part is dispose; and at least one of said third text information parts extends across a region where a diaper is expected to be worn on the intended wearer illustrated in said character part so as to obscure said region of the intended wearer illustrated in said character part.

2. A packaging bag for diapers according to claim 1, wherein said intended wearer illustration display part shows at least a boy of girl who is thee to six years old.

3. A diaper package formed by packaging said diapers in said packaging bag for diapers according to claim 1, wherein said character part is placed in a position which is to be a front face of said diaper package when said diaper package is in a displayed state.

4. A diaper package formed by packaging said diapers in said packaging bag for diapers according to claim 2, wherein said character part is placed in a position which is to be a front face of said diaper package when said diaper package is in a displayed state.

5. A diaper package display, comprising:

a first package group formed by arranging plural first diaper packages each including a packaging bag filled with first disposable diapers of which an intended wearer is a child 10 months old or older; and a second package group formed by arranging plural second diaper packages containing second disposable diapers smaller than the first disposable diapers;

wherein said packaging bag of each of the first diaper packages comprises:

opposite front and rear faces, and opposite side faces connecting the front and rear faces, respectively a first intended wearer illustration display part mainly showing one or more illustrations of said intended wearer on the front face of said packaging bag, said first intended wearer illustration display part comprising a first character part showing said intended wearer wearing clothes in a state wherein a diaper is worn so as not to be exposed outside said clothes;

a plurality of text information parts that include product information about the first diapers contained in the packaging bag, said text information parts comprising first text information parts on at least one of the side faces of the packaging body;

second text information parts positioned between said intended wearer illustration display part and said first text information parts; and third text information parts positioned horizontally in a width direction of said packaging bag and across said first intended wearer illustration display part in a region where a diaper is expected to be worn on the intended wearer illustrated in said first character part so as to obscure said region of the intended wearer illustrated in said first character part;

wherein said first intended wearer illustration display part and said first through third text information parts are all disposed on a roughly rectangular area which is 60% to 90% of an upper part in a vertical direction of the overall packaging bag when said packaging bag is empty, whereas a lower part of the empty packaging bag defines an opening part though which the first diapers are inserted into the packaging bag, and said first character part is disposed near a center line along the vertical direction of said packaging bag; and said first character part is placed in a position which is to be a front face of said first diaper package when said first diaper package is in a displayed state;

each said second diaper package comprises a second intended wearer illustration display part mainly showing one or more illustrations of a newborn or an infant on a surface of said second diaper package, said second intended wearer illustration display part comprising a second character part showing said newborn or said infant wearing a diaper in an exposed state; and said first package group and said second package group are displayed so as to be horizontally or vertically adjacent to each other, wherein a height of each of the second packages is smaller than that of the first packages.

6. A diaper package display according to claim 5, wherein said first intended wearer illustration display part shows a child who is thee to six years old.

7. A diaper package display according to claim 5, wherein said first and second diaper package groups are placed according to ages of the respective intended wearers on display shelves which are vertically arranged in plural levels.

8. A diaper package display according to claim 6, wherein said first and second diaper package groups are placed according to ages of the respective intended wearers on display shelves which are vertically arranged in plural levels.

9. A diaper package display, comprising:

a first package group formed by arranging plural first diaper packages each being a packaging bag according to claim 3 filled with the diapers of which the intended wearer is a child 10 months old or older; and a second package group formed by arranging plural second diaper packages containing disposable diapers smaller than the diapers of said first diaper packages, each said second diaper package comprising a second intended wearer illustration display part mainly showing one or more illustrations of a newborn or an infant on a surface of said second diaper package, said second intended wearer illustration display part comprising a second character part showing said newborn or said infant wearing a diaper in an exposed state;

wherein said first package group and said second package group are displayed so as to be horizontally or vertically adjacent to each other, wherein a height of each of the second packages is smaller than that of the first packages.

10. A diaper package display according to claim 9, wherein said first intended wearer illustration display part shows a child who is thee to six years old.

11. A diaper package display according to claim 9, wherein said first and second diaper package groups are placed according to ages of the respective intended wearers on display shelves which are vertically arranged in plural levels.

12. A diaper package display according to claim 10, wherein said first and second diaper package groups are placed according to ages of the respective intended wearers on display shelves which are vertically arranged in plural levels.

13. The packaging bag for diapers according to claim 1, wherein the entire front face of the packaging bag, including said intended wearer illustration display part and said text information parts, gives no direct graphical hint of what is inside the packaging bag.

14. The diaper package display according to claim 5, wherein the entire front face of the packaging bag, including said first intended wearer illustration display part and said text information parts, gives no direct graphical hint of what is inside the packaging bag.

15. The diaper package display according to claim 9, wherein the entire front face of the packaging bag, including said first intended wearer illustration display part and said text information parts, gives no direct graphical hint of what is inside the packaging bag.

* * * * *